United States Patent [19]

Cochran et al.

[11] Patent Number: 4,545,720

[45] Date of Patent: Oct. 8, 1985

[54] QUICK COUPLER ASSEMBLY

[75] Inventors: Gary L. Cochran; Dean O. Baum, both of Burlington, Iowa

[73] Assignee: J. I. Case Company, Racine, Wis.

[21] Appl. No.: 611,309

[22] Filed: May 17, 1984

[51] Int. Cl.[4] ..... B66C 23/00

[52] U.S. Cl. ..... 414/723; 172/275

[58] Field of Search ..... 414/723; 172/272, 273, 172/274, 275

[56] References Cited

U.S. PATENT DOCUMENTS

| | | | |
|---|---|---|---|
| 3,672,521 | 6/1972 | Bauer et al. | 414/723 |
| 3,794,195 | 2/1974 | Clevenger et al. | 414/723 |
| 3,818,551 | 6/1974 | Coughran, Jr. | 414/723 X |
| 3,883,015 | 5/1975 | Gorby | 414/723 |
| 4,119,225 | 10/1978 | Macht et al. | 414/723 |

*Primary Examiner*—Robert J. Spar
*Assistant Examiner*—Dennis Williamson
*Attorney, Agent, or Firm*—Cullen, Sloman, Cantor, Grauer, Scott & Rutherford

[57] ABSTRACT

A quick coupler assembly for attaching a material handling bucket or the like to the free ends of lift arms extending from a loader. The quick coupler assembly includes an elongated cross member having hitch brackets on its opposite ends. Each hitch bracket includes an end which is received against the underside of an upper attachment member on the rear wall of the bucket near the top edge thereof. The opposite end of the hitch bracket is configured for engagement against a lower inclined ramp extending along the bottom rear edge of the bucket. The coupler assembly further includes an over-center locking mechanism consisting of a pivotal handle and link connected to a shaft with a wedge on the lower end of the shaft. The shaft and wedge are slidably movable in response to over-center movement of the handle and link such that the wedge moves downwardly and passes through openings in a lower hitch bracket attachment member and the lower inclined bucket ramp for locking the quick coupler assembly to the bucket. After the operator has located the bucket in a hanging position on the quick coupler assembly, the assembly is rotated rearwardly such that an end of the handle is pushed against a stop member. As a result, the handle and link are pushed over center thereby forcing the wedge downwardly through the openings in the attaching members between the hitch bracket and bucket for securely attaching the bucket to the coupler assembly.

1 Claim, 4 Drawing Figures

QUICK COUPLER ASSEMBLY

BACKGROUND OF THE INVENTION

The present invention relates to an apparatus for attaching implements to the free end of a front end loader, and more particularly, to an improved quick coupler assembly for attaching buckets or the like to the front end loader lift arms.

It is known to provide earth-working machines such as front end loaders with different sizes and types of material handling implements or buckets to perform numerous working operations. Changing from one bucket to another is a problem because of the time and labor expended in the changeover. The buckets are heavy and awkward to manipulate and many times special tools are required to make the changeover. It is an object of this invention to provide a quick coupling assembly for easily coupling and releasing different buckets to the same front end loader lift arms.

The prior art is already aware of various arrangements for quickly attaching implements or the like to front end loaders. These devices exist in various complex forms and some of them require that the attaching pieces be accurately and carefully aligned and then the operator must maneuver a fastening or securing member in order to complete the attachment. Some of the prior art devices even require that the operator leave his seat in order to maneuver parts included in the attachment device to complete the attaching. Accordingly, it is a general object of the present invention to improve upon the prior art quick attachment devices and specifically to do so with a device which is simple but sturdy in construction and, therefore, is reliable in its operation and in its strength in supporting a lifting implement such as a loader bucket or the like.

More specifically, there has been a need for a quick attachment device which permits ready and easy attachment and detachment of an implement without requiring that the operator leave his seat for achieving the attaching. Further, there has been a need for a quick attachment device which is arranged to have the lifting implement disposed at its closest possible location relative to the extending ends of the front end loader lifting arms so that there is only a minimal over-balance from the lifting implement acting on the lifting arms.

The disadvantages of prior art quick attaching mechanisms have resulted in the present quick coupling assembly which is compact from the point of attachment with the front end loader lift arms to the implement itself.

SUMMARY OF THE INVENTION

In accordance with the present invention, the improved quick coupler assembly permits various buckets to be used with the same front end loader lift arms, and it permits a bucket to be attached or released from the lift arms without the operator leaving his seat.

The quick coupler assembly is operationally connected to components on the rear wall of the bucket. The bucket includes upper attachment members which extend outwardly from the rear wall of the bucket. Further, the bucket includes an inclined ramp along its bottom rear edge which also extends outwardly from the rear wall of the bucket. The inclined bucket ramp includes openings therethrough which permit secure attachment between the quick coupler assembly and the bucket.

The quick coupler asssembly includes an elongated cross member having hitch brackets on its opposite ends with the entire coupler assembly being pivotally attached between the loader lift arms. Each hitch bracket includes an upper attachment member which is rotated into a coupling position beneath a respective upper bucket attachment member. Further, each hitch bracket includes a lower attachment member which is movable into engagement with the lower inclined bucket ramp.

To begin the coupling process, the operator actuates a tilt cylinder thereby causing the quick coupler assembly hitch brackets to pivot forwardly and downwardly towards the bucket so that the front end loader can be maneuvered to engage the hitch bracket attachment members against the underside of the bucket attachment members. The operator then raises the loader lift arms and rotates the hitch brackets rearwardly until the lower hitch bracket attachment members engage the lower inclined bucket ramp. The bucket is then hanging on the quick coupler assembly without being locked thereto.

The quick coupler assembly further includes at each hitch bracket an over-center locking mechanism consisting of a handle, link, shaft and wedge. Each handle is pivotally attached to a hitch bracket and to one end of the link. The link, in turn, is pivotally attached to a head which is secured on one end of the shaft. The shaft and wedge are slidably movable during movement of the handle and link such that the wedge moves downwardly through openings in the lower hitch bracket attachment member and lower inclined bucket ramp for locking the quick coupler assembly to the bucket.

During the initial maneuvering of the bucket for the coupling process, the handle is located in a first position such that when the coupler assembly is rotated rearwardly the end of the handle is pushed against a stop member. As a result, the handle and link are pushed over center thereby forcing the wedge downwardly through the openings in the lower hitch bracket attachment member and lower inclined bucket ramp for securely attaching the bucket to the coupler assembly.

The bucket is uncoupled from the quick coupler by performing the coupling steps in reverse. That is, the bucket is rotated rearwardly until the pivotal handle on the hitch bracket engages the stop member. A delatch arm is then rotated downwardly to engage a pin on the handle for holding the upper end of the handle in place while the bucket is rolled out. This causes the handle and link to shift back to their original position thereby retracting the wedge and freeing the bucket. The bucket is then left hanging on the quick coupler assembly as previously described for easy uncoupling.

Other advantages and meritorious features of the quick coupler assembly of the present invention will be more fully understood from the following detailed description of the invention, the appended claims, and the drawings, a brief description of which follows.

DETAILED DESCRIPTION OF THE INVENTION

An earth-working machine including the quick coupler assembly made in accordance with the teachings of the present invention is illustrated in FIGS. 1–4.

Figure 1:
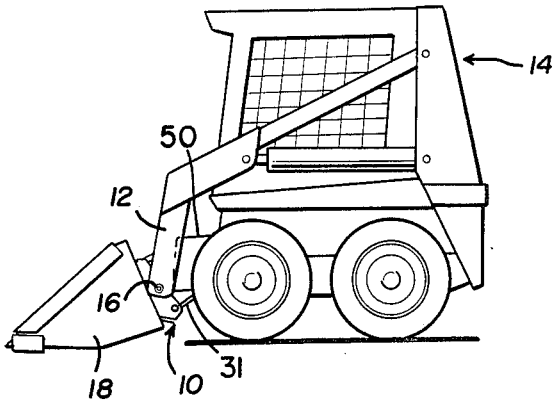
FIG. 1 is a side elevational view of a front end loader including the quick coupler assembly of the present invention.
Figure 2:
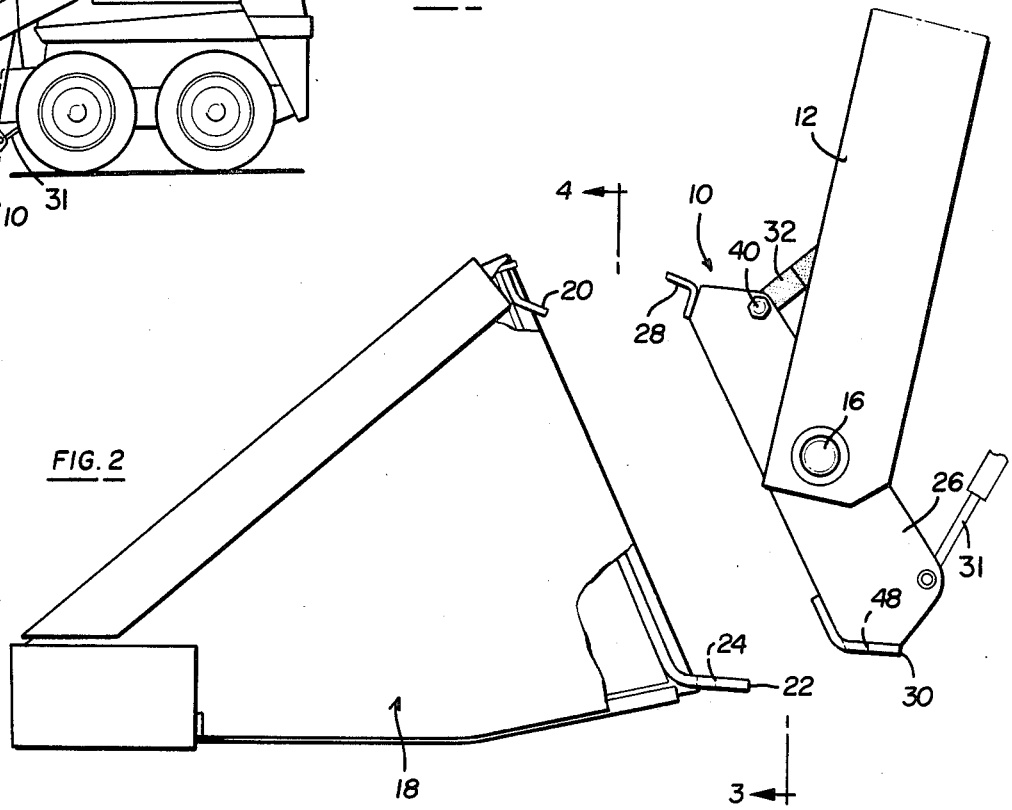
FIG. 2 is a fragmentary side elevational view illustrating the movement of the hitch brackets to begin the coupling process.
Figure 3:
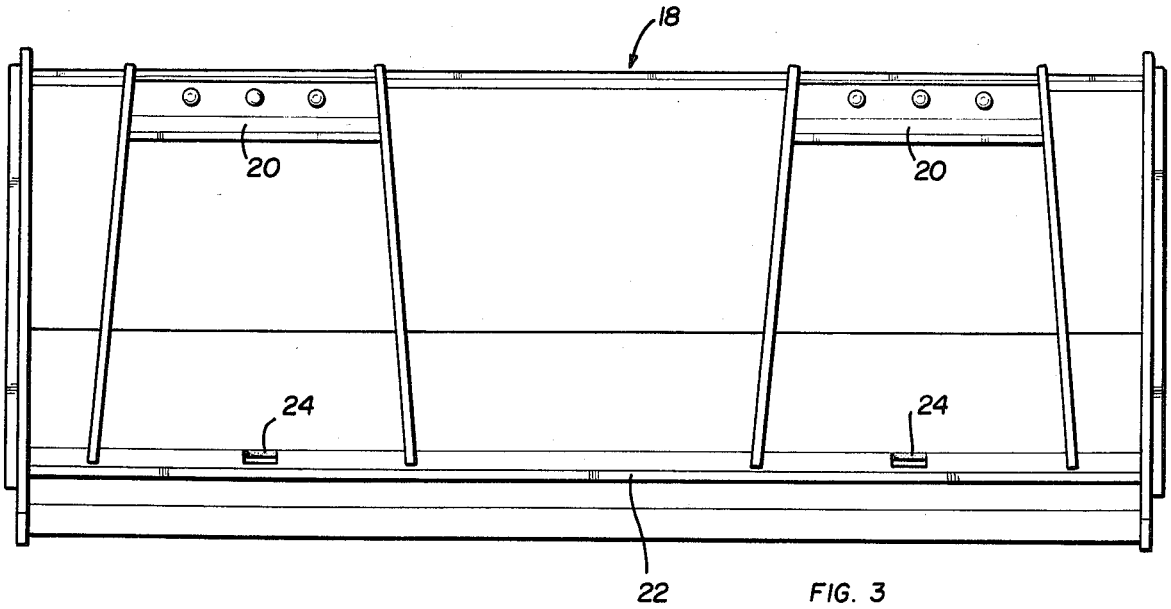
FIG. 3 is a rear end view of the bucket taken along line 3—3 in FIG. 2.

The general nature of the present invention may be understood with reference to FIGS. 1–3. The quick coupler assembly 10 (one side of which is shown in detail in FIG. 4) is pivotally connected between the free ends of loader arms 12 on front end loader 14 by pins 16. Quick coupler assembly 10 may be releasably secured to the rear wall of bucket 18 without the operator leaving his seat to complete the attaching. Bucket 18 may also be uncoupled from coupler assembly 10 without the operator leaving his seat.

Bucket 18 includes upper attachment members 20 which extend outwardly from the rear wall of the bucket. Further, bucket 18 includes an inclined ramp 22 along its bottom rear edge which also extends outwardly from the rear wall of the bucket. Inclined bucket ramp 22 includes openings 24 therethrough which permit secure attachment between coupler assembly 10 and bucket 18 as will be described.

Figure 4:
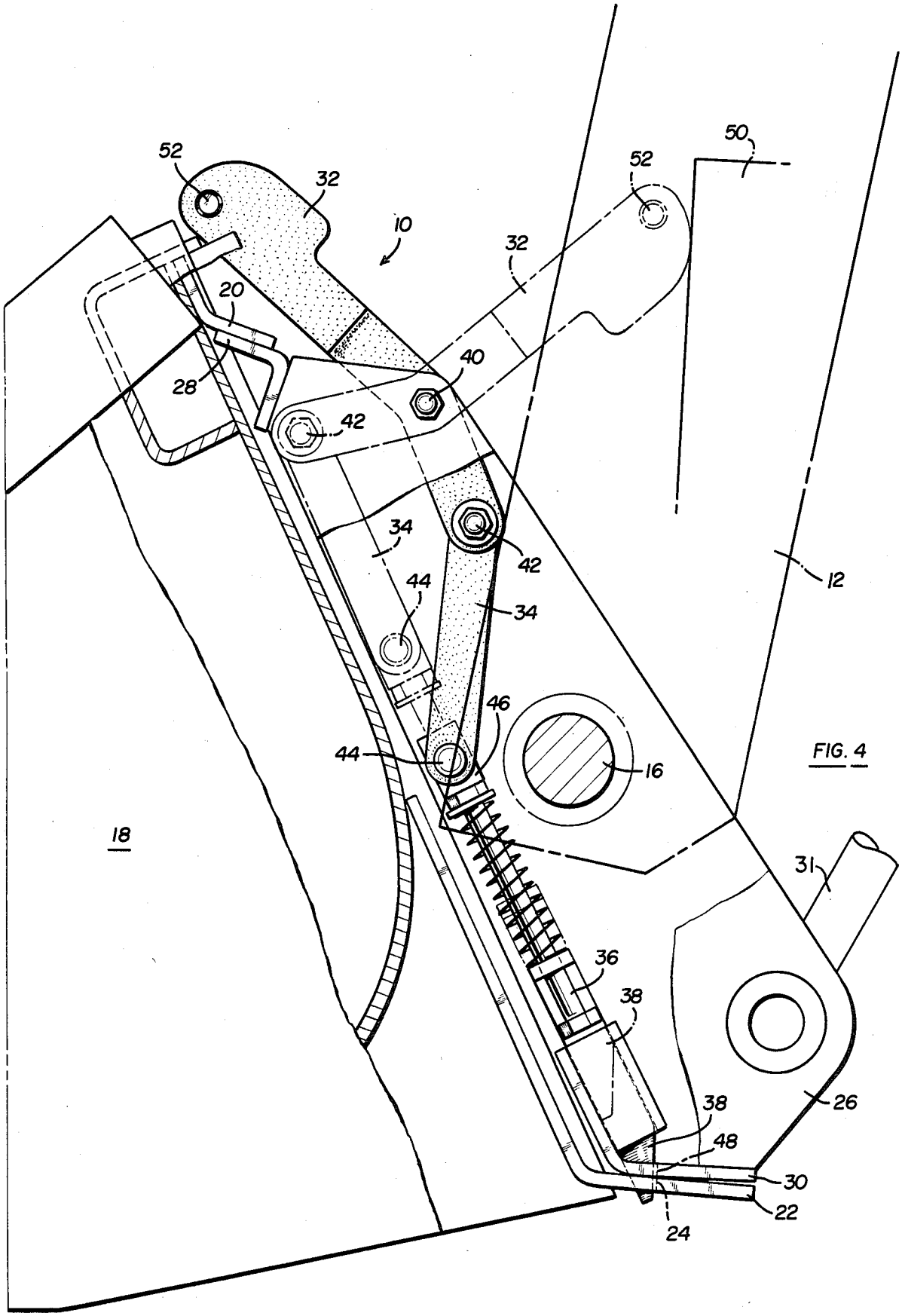
FIG. 4 is an enlarged fragmentary side elevational view of the quick coupler assembly illustrating the operation thereof.

One side of the quick coupler assembly 10 is shown in detail in FIG. 4. The side shown is operable for engaging and coupling the lefthand side of the bucket 18 as viewed in FIG. 3. An identical mechanism to that shown in FIG. 4 is also provided for engaging and coupling the righthand side of the bucket 18 as viewed in FIG. 3. However, since both sides of the coupler assembly 10 are identical, only one side has been shown, with the understanding that the opposite side is identical and operates in the same manner.

The quick coupler assembly 10 includes an elongated, cross member (not shown) having hitch brackets 26 at its opposite ends with the entire assembly being pivotally attached between loader lift arms 12 by pins 16. Each hitch bracket 26 includes an upper attachment member 28 which is rotated into a coupling position beneath a respective bucket attachment member 20, as shown in FIG. 4. Further, each hitch bracket 26 includes a lower attachment member 30 which is movable into engagement with the lower inclined bucket ramp 22, as also shown in FIG. 4.

To begin the coupling process, the operator actuates a tilt cylinder 31 (FIG. 2), which is connected to hitch bracket 26, thereby causing hitch bracket 26 to pivot forwardly and downwardly towards bucket 18 so that the front end loader 14 can be maneuvered to engage the upper attachment member 28 against the underside of bucket attachment member 20. The operator then raises lift arms 12 and rotates hitch bracket 26 until the lower attachment member 30 engages the lower inclined bucket ramp 22. The bucket 18 is then hanging on quick coupler 10 without being locked thereto.

Referring now to FIG. 4, coupler assembly 10 further includes at each hitch bracket 26 an over-center latching mechanism consisting of handle 32, link 34, shaft 36 and wedge 38. Handle 32 is pivotally attached to hitch bracket 26 by pin 40 and to one end of link 34 by pin 42. Link 34 is pivotally attached by pin 44 to a head 46 which is secured to an end of shaft 36. Shaft 36 and wedge 38 are slidably movable during movement of link 34 between the phantom and solid line positions of FIG. 4. As wedge 38 moves downwardly, it passes through opening 48 in attachment member 30 and opening 24 in bucket ramp 22 for locking quick coupler assembly 10 to bucket 18.

Handle 32 and link 34 are in the phantom line position of FIG. 4 when the operator initially engages the upper attachment member 28 against the underside of bucket attachment member 20 and then raises lift arms 12 for bringing the lower attachment member 30 into mating engagement with lower inclined bucket ramp 22. Thereafter, hitch bracket 26 is rotated rearwardly by tilt cylinder 31 such that the end of handle 32 is pushed against stop member 50. As a result, handle 32 and link 34 are pushed over center about rotational axis 40 (i.e., into the solid line position in FIG. 4), thereby forcing wedge 38 downwardly through openings 48 and 24 for securely attaching bucket 18 to coupler assembly 10.

Bucket 18 is uncoupled from quick coupler assembly 10 by performing the coupling steps in reverse. That is, bucket 18 is rotated rearwardly by tilt cylinder 31 until handle 32 (in its solid line position of FIG. 4) engages stop member 50. A delatch arm (not shown) is then rotated downwardly to engage pin 52 on handle 32 for holding the upper end of handle 32 in place while bucket 18 is rolled out. This causes handle 32 and link 34 to shift back to the phantom line position of FIG. 4 thereby retracting wedge 38 and freeing bucket 18. Bucket 18 is then left hanging on hitch bracket 26 as previously described for easily uncoupling.

It will be apparent to those skilled in the art that the foregoing disclosure is exemplary in nature rather than limiting, the invention being limited only by the appended claim.

We claim:

1. A quick coupler assembly for attaching a material handling bucket to the free ends of lift arms extending from a tractor loader, said quick coupler assembly including an elongated cross member having hitch members mounted on its opposite ends with the assembly being pivotally attached to said lift arms, means for rotating said coupler assembly forwardly and rearwardly relative to said lift arms, an upper coupling member that extends outwardly from a rear wall on said bucket near the top edge thereof and a lower coupling member that extends outwardly from said bucket rear wall near the bottom edge thereof, each hitch member including an upper attachment member which is rotated into engagement against said upper coupling member, the opposite end of each hitch member including a lower attachment member for mating engagement with said lower coupling member, said lower attachment member and lower coupling member including openings which are movable into an aligned relationship, said coupler assembly further including an over-center latching mechanism operatively associated with each hitch member, said over-center latching mechanism including a handle pivotally connected to a respective hitch member and to one end of a link, said link being pivotally attached to one end of a slidably movable shaft member having a wedge locking member on the opposite end thereof, and said quick coupler assembly being movable into a first position wherein each hitch bracket upper attachment member is brought into engagement against the underside of a respective bucket upper coupling member and a second position wherein each said lower attachment member is brought into engagement with said lower bucket coupling member such that said lower attachment member and lower coupling member openings become aligned, and said quick coupler assembly being movable rearwardly by said means for rotating said coupler assembly from said second position such that said handle engages a stop member on said tractor loader for pushing said handle and pivotally attached link over-center thereby slidably forcing said wedge member through said openings for securely attaching said bucket to said coupler assembly.

* * * * *